US006244478B1

(12) United States Patent
Lee

(10) Patent No.: US 6,244,478 B1
(45) Date of Patent: Jun. 12, 2001

(54) CLOTHES HANGER

(76) Inventor: Jae Hwon Lee, Anyangbonvila 21-dong 101-ho, 91-21, Anyang 1-dong Manan-ku, Anyang City, Kyungkido 430-011 (KR)

( * ) Notice: Subject to any disclaimer, the term of this patent is extended or adjusted under 35 U.S.C. 154(b) by 0 days.

(21) Appl. No.: 09/530,841

(22) PCT Filed: Nov. 6, 1998

(86) PCT No.: PCT/KR98/00355

§ 371 Date: May 4, 2000

§ 102(e) Date: May 4, 2000

(87) PCT Pub. No.: WO99/23922

PCT Pub. Date: May 20, 1999

(30) Foreign Application Priority Data

Nov. 8, 1997 (KR) ..... 97-31444 U

(51) Int. Cl.[7] ..... A47G 25/40

(52) U.S. Cl. ..... 223/90; 223/89

(58) Field of Search ..... 223/88, 94, 90, 223/85, 89

(56) References Cited

U.S. PATENT DOCUMENTS

| | | | | |
|---|---|---|---|---|
| 941,115 | * | 11/1909 | Vanderford | 223/88 |
| 980,219 | * | 1/1911 | Drucker | 223/88 |
| 989,587 | * | 4/1911 | Edlund | 223/88 |
| 996,504 | * | 6/1911 | Mixa | 223/88 |
| 3,651,999 | * | 3/1972 | Fioca | 223/88 |
| 5,038,979 | * | 8/1991 | Traylor | 223/88 |

* cited by examiner

*Primary Examiner*—Bibhu Mohanty
(74) *Attorney, Agent, or Firm*—Eric Bleich

(57) ABSTRACT

A clothes hanger capable of hanging together upper clothes and lower clothes of various suit. In case either when taking off upper and lower clothes from clothes hanger to put on the clothes upon going out, or else taking off the upper and lower clothes and haging up upon coming back after going out, in order to make to be able to pick up and put on from the clothes hanger as it is in response to an order of wearing the clothes, and to hang up to the clothes hanger as it is in response to an order of taking off the clothes, the invention is made such that the lower clothes hanger is automatically projected by a returning resilient force whereby be stood erect and distanced apart and thereby optimum state to hang up the lower clothes is obtained, and once the lower clothes is hung up, the lower clothes hanger is naturally closely contacted to the clothes hanger main body whereby the clothes hanger volume is minimized.

3 Claims, 2 Drawing Sheets

CLOTHES HANGER

TECHNICAL FIELD

The present invention relates to a clothes hanger capable of hanging upper-clothes and lower-clothes of various clothes such as man's suit or lady's suit (coat, jacket, trousers, blouse, sack, skirt etc.) together, and more particularly, to a clothes hanger which is very convenient to use by making not to give mutual interference of upper and lower clothes since the lower-clothes hanger is automatically projected from the clothes hanger main body whereby made to be stood erect and distanced apart therefrom so as to be able to either hang up in response to an order of taking off the clothes or else picking up and putting on in response to an order of wearing on the clothes at the time when either taking out the upper-clothes and lower-clothes from the clothes hanger in order to put on the clothes upon going out or else taking off and hanging up the upper-clothes and lower-clothes upon coming back to home after going out.

BACKGROUND ART

A conventional clothes-hanger which has been known as Japanese laid-open utility model application Hei-2-13076 was an article which connected by a sub-clothes hanger to be hung with lower clothes of suit at central down of main clothes hanger to be hung with upper clothes of suit by a torsional spring arm, and the sub-clothes hanger is made to be got out from same horizontal level of main clothes hanger by utilizing the torsional spring arm whereby mutual interference could be excluded up to some degree upon hanging up or taking off the upper-clothes and lower-clothes, however much inconvenience causing therefrom was still present, namely after hanging the upper clothes to the main clothes hanger and hanging the lower clothes to the sub-clothes hanger which is projected by the torsional spring arm, there has been troublesome to unfold the torsional spring arm to a close flat plane in order to decrease its volume, and a cumbersome to fold back again the torsional spring arm which was unfolded to a close flat plane state to a projected state was followed at every using time, and also there has been a problem that the torsional spring arm was eccentrically made so as to be inclined to any one side.

DISCLOSURE OF INVENTION

The present invention is invented to solve such problems of conventional technique, and in connecting a clothes hanger main body and lower-clothes hanger in which upper-clothes and lower-clothes of suit are respectively hung not to be interfered each other, the lower-clothes hanger is made to be automatically projected from the clothes hanger main body by a returning resilient force of torsional spring member so as to be stood erect and distanced apart, and once the lower-clothes is hung, the lower-clothes hanger is naturally closely contacted to the main body according to own weight of the lower-clothes so as to minimize the volume, and in case of not using, a convenient locking hooks are used in order to make the volume to be minimized, and the lower-clothes hanger is made not to be eccentrical.

Therefore, an object of the present invention is to provide a clothes hanger which is convenient to use by making a optimum state to hang the lower-clothes in which a lower-clothes hanger is automatically projected from a clothes hanger main body by a returning resilient force of resilient connecting member made of resilient torsional spring whereby stood erect and distanced apart.

BEST MODE FOR CARRYING OUT THE INVENTION

Hereinafter, a preferred embodiment of the present invention will be described more in detail with reference to the accompanying drawings.

Figure 1:
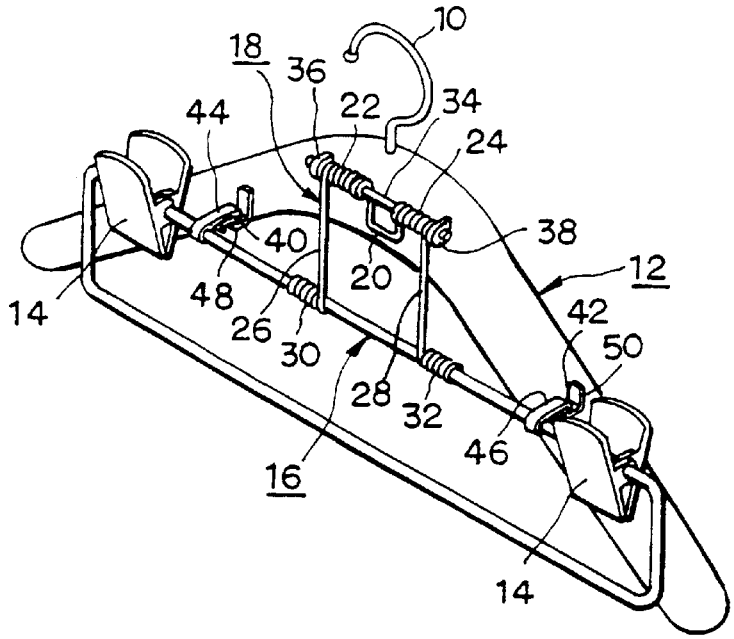
FIG. 1 is a perspective view showing a locked state of clothes hanger in accordance with the present invention.
Figure 2:
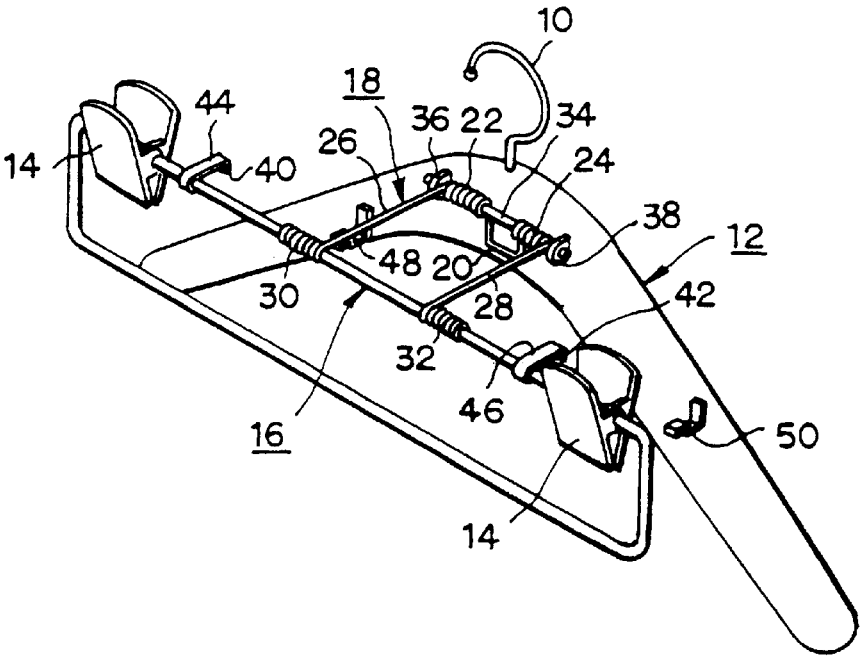
FIG. 2 is a perspective view showing a state that a lower-clothes hanger shown in FIG. 1 is projected from the clothes hanger main body and distanced apart therefrom.

As shown in FIG. 1 and FIG. 2, a clothes hanger main body 12 having a round hook 10 and a lower-clothes hanger 16 having clips 14 are connected by a resilient connecting member 18 as coil spring.

The resilient connecting member 18 is made such that in an ordinary coil spring formed with coil portions 22, 24 at both sides of a stopper 20 and having bridges 26, 28 extended from respective coil portions 22, 24, lower-clothes hanger rotating hinge 30, 32 are respectively formed to each free end side of the bridges 26, 28.

A pivot 34 is inserted to the coil portions 22, 24 of the resilient connecting member 18, and each end portion of the pivot 34 is inserted into protrusions 36, 38 formed to the clothes hanger main body 12, and a stopper 20 between the coil portions 22, 24 is fixed to the clothes hanger main body 12, so that the bridges 22, 24 can exert a resilient force.

The lower-clothes hanger 16 is inserted into the lower-clothes hanger rotating hinges 30, 32 formed to the bridges 22, 24 of the resilient connecting member 18, and locking hooks 44, 46 having pawls 40, 42 are fixed to end parts of the lower-clothes hanger 16, and hooking means 48, 50 corresponding to the locking hooks 44, 46 of the lower-clothes hanger 16 are fixed to the clothes hanger 12, so that either the lower-clothes hanger 16 is locked so as to be closely contacted to the clothes hanger main body 12 as in FIG. 1, or else the lower-clothes hanger 16 is automatically projected from the clothes hanger main body 12 by a returning resilient force of the resilient connecting member 18 whereby be stood erected and distanced apart as in FIG. 2, so as to make most suitable state to hang up the lower-clothes.

And, in order to be able to conveniently hang up the lower-clothes to the lower-clothes hanger 16, it is made either to use the clip 14, or else to hang the lower-clothes by passing through rectangular-shaped hanger and folding into halves.

INDUSTRIAL APPLICABILITY

Inasmuch as the present invention is made of a clothes hanger main body 12 to be hung with upper-clothes (A) of suit and a lower-clothes hanger 16 to be hung with lower-clothes (B) are connected by a resilient connecting member 18 having lower-clothes hanger rotating hinges 30, 32 formed to free end portions of bridges 26, 28 extended from resilient coil portions 22, 24 positioned at both sides of stopper 20, from a state that the lower-clothes hanger 16 is closely contacted to the clothes hanger main body 12 so as to be smaller in volume as in FIG. 1, to a state that the lower-clothes hanger 16 is automatically projected from the clothes hanger main body 12 whereby be stood erect and distanced apart as in FIG. 2, most suitable state to hang up the lower-clothes (B) is obtained.

Figure 3:
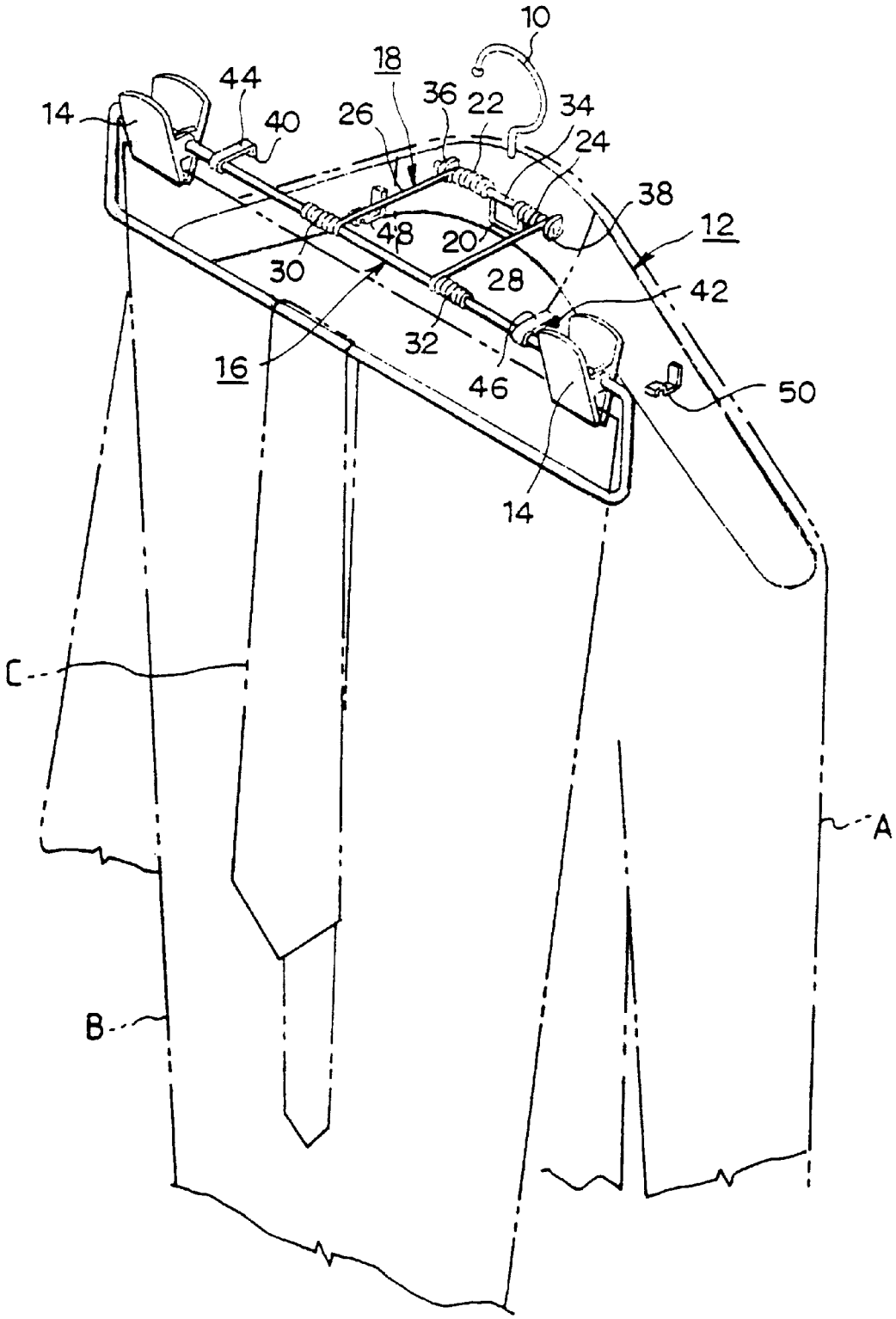
FIG. 3 is a view showing a using state of the clothes hanger in accordance with the present invention.

Even in a state that the lower-clothes (A) is hung up to the clothes hanger main body 12, the lower-clothes (B) is made to be more conveniently hung up to the lower-clothes hanger 16 without mutual interference as in FIG. 3, and once the lower-clothes (B) is hung up to the lower-clothes hanger 16, the lower-clothes hanger 16 is naturally closely contacted to the clothes hanger main body 12 according to own weight of the lower-clothes whereby volume is minimized, inversely in case where the lower-clothes is taken off from the lower-clothes hanger 16 and then the upper-clothes (A) is taken off from the clothes hanger main body 12 also, it is very convenient because it can be taken off and put on as it is in response to wearing order without mutual interference, and in case when the clothes hanger is not used as the clothes is not hung up to the clothes hanger, in order to make the clothes hanger volume to be minimized, the lower-clothes hanger 16 can be fixed to the clothes hanger main body 12.

What is claimed is:

1. A garment hanger consisting of:

an upper garment hanger and lower garment hanger adjacent said upper garment hanger, said upper and lower garment hangers being positioned apart from each other, said upper garment hanger consisting of a hanger arm, said lower garment hanger consisting of a trousers hanger formed in the shape of a rectangle having a top, bottom and a first and second side extension, said upper garment hanger including a hanging loop and a coil spring, a resilient connecting member including a pair of bridges attached to said coil spring, a pair of rotating hinges connected to said lower garment hanger and being integral with said bridges, a stopper member being located between said bridges, said lower garment hanger having fixed on said top extension at least one grip member and having a pair of locking hooks adjoining said lower garment hanger, hooking means fixed to said upper garment hanger for lockably engaging said pair of locking hooks adjoining said lower garment hanger.

2. A garment hanger, comprising:

an upper garment hanger, a lower garment hanger, a connecting device, and cooperating locking means, said upper garment hanger comprising first and second arm members and a center section connecting said arm members and having two opposing protrusions, said lower garment hanger comprising top and bottom members and first and second side members, said top, bottom and side members integrally connecting in an endless, substantially rectangular formation, said top member having garment securing means, said connecting device comprising first and second bridge members and a pivot member, said pivot member having first and second ends and a stopper member extending from the center thereof, with said first and second ends engaging said protrusions and said stopper member abutting said center section, said bridge members each comprising an upper and lower end and a linear member, said upper ends coiling into springs to encircle said first and second ends of said pivot member between said protrusions and the center thereof, and said lower ends coiling into springs to encircle said top member so that said connecting device affords a spring-actuated rotational force to move said lower garment hanger away from said upper garment hanger, said cooperating locking means disposed on said upper and lower garment hangers to maintain said upper and lower garment hangers in close proximity when said locking means are deployed.

3. The garment hanger of claim 2, wherein said cooperating locking means comprise hooks and receiving members, said hooks attaching to said top member of said lower garment hanger and said receiving members attaching to said arm members of said upper garment hanger, said hooks fashioned to insertably and releaseably engage said receiving members.

* * * * *